US007669795B2

(12) United States Patent
Brown

(10) Patent No.: US 7,669,795 B2
(45) Date of Patent: Mar. 2, 2010

(54) REEL ASSEMBLY

(75) Inventor: Ian Anthony Brown, 2 Osborne Road, Farnborough, Hampshire (GB) GU14 6PT

(73) Assignees: Ian Anthony Brown, Farnborough (GB); Neil Redley, North Baddesley (GB)

( * ) Notice: Subject to any disclaimer, the term of this patent is extended or adjusted under 35 U.S.C. 154(b) by 0 days.

(21) Appl. No.: 12/150,206

(22) Filed: Apr. 24, 2008

(65) Prior Publication Data

US 2009/0127370 A1 May 21, 2009

(30) Foreign Application Priority Data

Nov. 16, 2007 (GB) ..... 0722581.6

(51) Int. Cl.
*B65H 27/00* (2006.01)

(52) U.S. Cl. ..... 242/397; 242/397.2; 242/406

(58) Field of Classification Search ..... 242/397, 242/397.1–397.2, 397.4–397.5, 406, 407, 242/399.2; 137/355.23, 355.26
See application file for complete search history.

(56) References Cited

U.S. PATENT DOCUMENTS

| | | | | | |
|---|---|---|---|---|---|
| 2,530,114 | A | * | 11/1950 | Bugg et al. | 242/375.1 |
| 2,777,647 | A | * | 1/1957 | Fullerton et al. | 242/561 |
| 2,907,534 | A | * | 10/1959 | Benstein | 242/397.2 |
| 2,964,258 | A | * | 12/1960 | Kutil | 242/399.2 |
| 3,176,931 | A | * | 4/1965 | Hannay | 242/376.1 |
| 3,184,180 | A | * | 5/1965 | Rockwell | 242/399.2 |
| 5,678,599 | A | * | 10/1997 | Moss | 137/377 |
| 5,787,923 | A | * | 8/1998 | Shea et al. | 137/355.26 |
| 7,150,425 | B2 | * | 12/2006 | Banaszkiewicz et al. | 242/385.3 |

* cited by examiner

*Primary Examiner*—Sang Kim
(74) *Attorney, Agent, or Firm*—Woodcock Washburn LLP

(57) ABSTRACT

A reel assembly (1) comprising a pivotable guide arrangement (4) for guiding material to and from a drum portion (2) of the reel assembly, the guide arrangement being resiliently biased towards an undeflected position.

8 Claims, 6 Drawing Sheets

REEL ASSEMBLY

PRIORITY INFORMATION

This application claims priority to United Kingdom Application No. 0722581.6, filed on Nov. 16, 2007, which is hereby incorporated by reference in its entirety.

FIELD OF THE INVENTION

The present invention relates to reel assemblies.

BACKGROUND OF THE INVENTION

Reel assemblies are known which are arranged to be attached to an upright wall. Such assemblies comprise a mounting structure to which is attached a rotatable drum and a guide arm assembly. The guide arm assembly is fixed relative to the mounting structure. We have realized that this is not always convenient for users of different heights who may which to pull hose from the reel from different distances from the reel. We have realized that this is because the effort required by the user to withdraw hose from the drum depends on the user's height (relative to the height at which the reel assembly is positioned) as well as the distance of the user from the wall on which the reel is attached. We seek to provide an improved reel assembly.

SUMMARY OF THE INVENTION

According to the invention there is provided a reel assembly comprising a pivotable guide arrangement for guiding material to and from a drum portion of the reel assembly, the guide arrangement being resiliently biased towards an undeflected position.

In one embodiment of the invention comprises a reel assembly with a self-adjusting guide arm assembly which is arranged to automatically adjust to hose being played out by users of different heights and from different distances

BRIEF DESCRIPTION OF THE DRAWINGS

Various embodiments of the invention will now be described, by way of example only, with reference to the following drawings in which.

DETAILED DESCRIPTION OF ILLUSTRATIVE EMBODIMENTS

Figure 1:
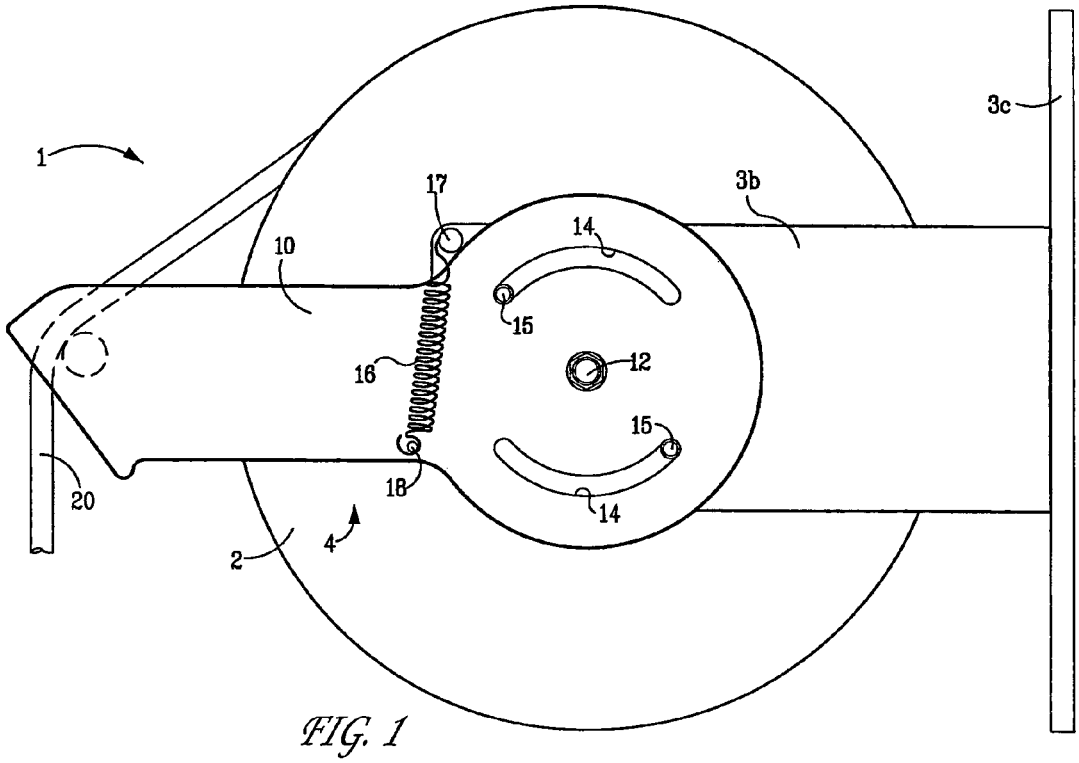
FIG. 1 is a schematic side view of a reel assembly in a first position.
Figure 2:
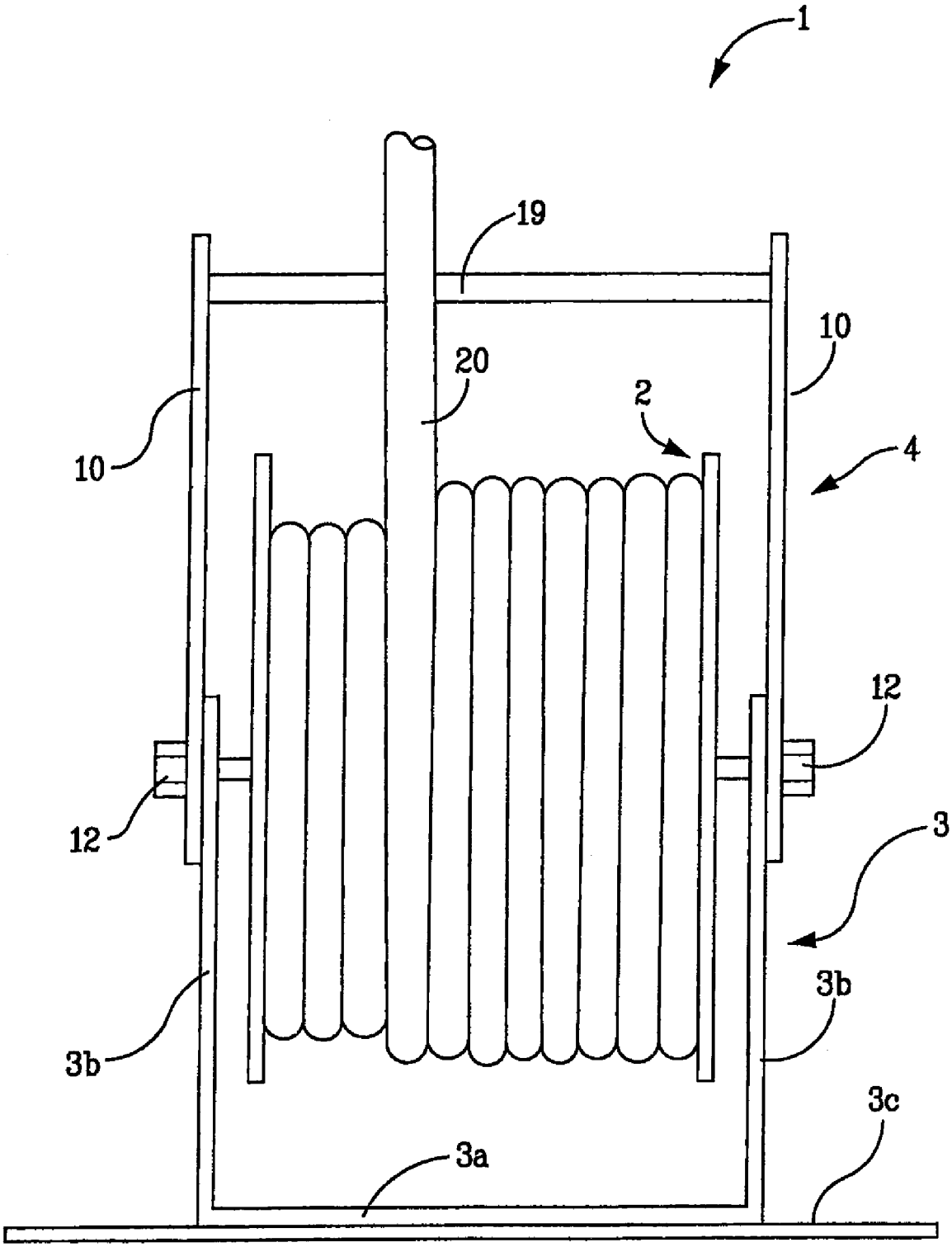
FIG. 2 is a schematic end view of a reel assembly.

With reference initially to FIGS. 1 and 2, a hose reel assembly 1 comprises a drum portion 2, a mounting structure 3 and a guide arrangement 4. The guide arrangement 4 is pivotably mounted relative to the mounting structure 3.

The mounting structure 3 comprises a basal portion 3*a* and two upstanding portions 3*b*. The basal portion has attached thereto a plate 3*c* which is provided with throughholes (not shown) which allow the plate to be secured to an upright wall by way of suitable fixings such as anchor bolts or the like.

The guide arrangement 4 comprises two arm portions 10 which are located at each side of the mounting structure 3. One end portion of each arm portion 10 is pivotably mounted to the mounting structure 3, and opposing surfaces of the arm portions 10 and the upstanding portions 3*b* contact each other in a low friction manner to allow for relative rotation. Low frictional engagement may be achieved by providing a low friction material between the arm portions and the upstanding portions. A headed fastener 12 ensures that the arm portion 10 is retained on the respective upstanding portion 3*b*. Each arm portion 10 comprises two arcuate slots 14. Each slot 14 receives a respective head 15 which is fixedly attached to the upstanding portion 3*b*.

To provide the resilient biasing a spring member 16 is provided. It is to be noted that, for the sake of simplicity of representation, the spring member 16 is not shown in FIG. 2. One distal end of the spring member 16 is secured to a post 17 and the other distal end is secured to the post 18. The post 17 is fast with the upstanding portion 3*b* and the post 18 is fast with the arm portion 10. The spring member 16 is arranged so as to resiliently bias the arm portion 10 towards the undeflected position shown in FIG. 1. The purpose of the slots 14 is to limit the extent of the rotational movement of the arm portions 10 relative to the upstanding portions 3*b*. As shown in FIG. 1 the respective distal ends of the slots 14 form stops which bear against the heads 15 and allow a maximum deflection of around ninety degrees.

Interposed between the free end portions of the arm portions 10 the guide arrangement further comprises an elongate roller guide 19 which comprises one or more rollers (not referenced).

Figure 3:
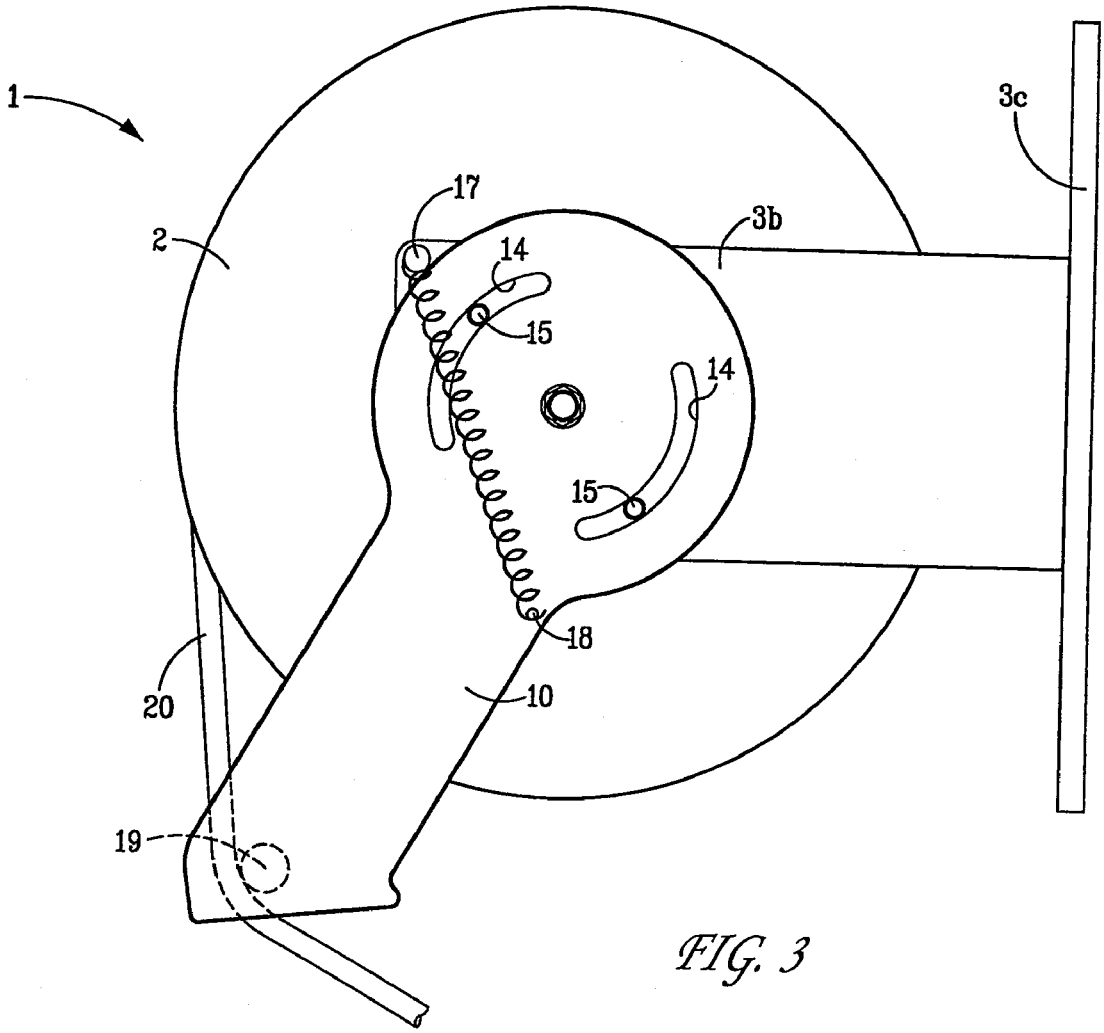
FIG. 3 is a schematic side view of a reel assembly in a second position.

In use the hose reel assembly 1 is used as follows. The drum portion 2 has wound round it, ribbonwise, a length of hose 20. The assembly 1 is then secured at a suitable height on an upright wall (not shown) by way of the plate 3*c*. One distal end of the hose 20 is connected to a supply of fluid, such as air. The other distal end of the hose is arranged to rest on the roller guide arrangement 19 and hang downwards so that the distal end is within reach of a user. Should the user wish to use the air supply he can simply grasp the free end of the hose 20, which would likely be provided with a controllable nozzle (not shown), and move the free end to the location where the air is required. By moving the free end of the hose 20 away from the reel assembly 1, and playing out wound hose, a force with a downward component is applied to the roller guide arrangement 19 which, in turn, causes the arm portions 10 to pivot downwardly against the tension of the spring 16. Advantageously, by arranging that the arm portions 10 are pivotable, it is significantly easier for the user to reach any desired location with the free end relative to the position of the reel assembly. The action of the spring member 16 causes the angular position of the guide arrangement to automatically adapt to the (relative) position of the user. For example, as can be seen in FIG. 3, the free end of the hose 20 has been taken to a location away from the reel assembly 1. Accordingly, the angular position of the guide arrangement has altered. The deflection depends on the lateral distance the free end of the hose is taken from the reel assembly. It is to be noted that the drum portion 2 is rotatably mounted relative to the mounting structure 3, and furthermore is connected to a resilient mechanism (not shown) which acts so as to bias the drum to wind hose back onto the drum portion 2—an arrangement which may be termed a spring rewind.

Figure 4:
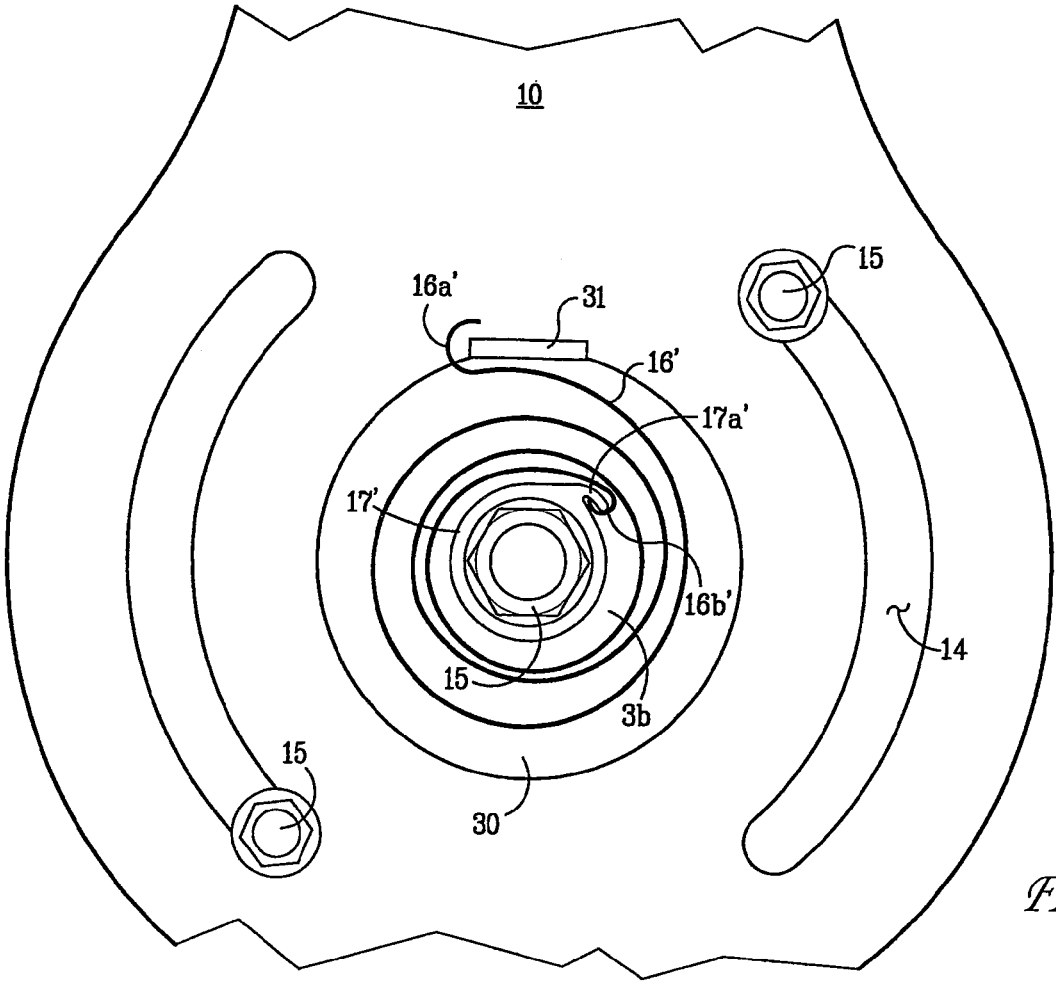
FIG. 4 is a schematic side view of a resilient biasing arrangement of a reel FIG. assembly, 5 is a schematic side view of a reel assembly in various positions.

With reference now to FIG. 4, an alternative resilient biasing mechanism for the guide arrangement is shown. Like, or very similar, features are designated by the same reference numerals. The helical spring 16 is replaced by a coiled or clock-type spring 16'. One end 16*a*' of the spring 16' is attached to an upstand feature 31 of an annular plate 30. The plate 30 is fixedly secured to the outer surface of the arm portion 10, and is concentric with a circular aperture made in the arm portion 10. A nut 12' is fixedly attached to the upstanding portion 3*b*. A retaining member 17 is configured to surround the nut 12' and to remain stationary relative to the nut 12'. The retaining member 17 comprises a hook portion 17*a*' which receives a cranked end portion 16*a*' of the spring 16'. Advantageously, a user is able to adjust the biasing tension produced by the spring 16', for example in the case that the reel assembly is used with a particularly heavy type of hose and so a greater torque is required to overcome the weight of the hose on the guide 19 so that the guide arrangement can return to an undeflected position. In order to adjust the tension, the user slides the retaining member 17' away from the nut 12', and replaces the member on the nut so that the hook portion 17*a*' is in a different angular position (relative to the nut 12').

Figure 5:
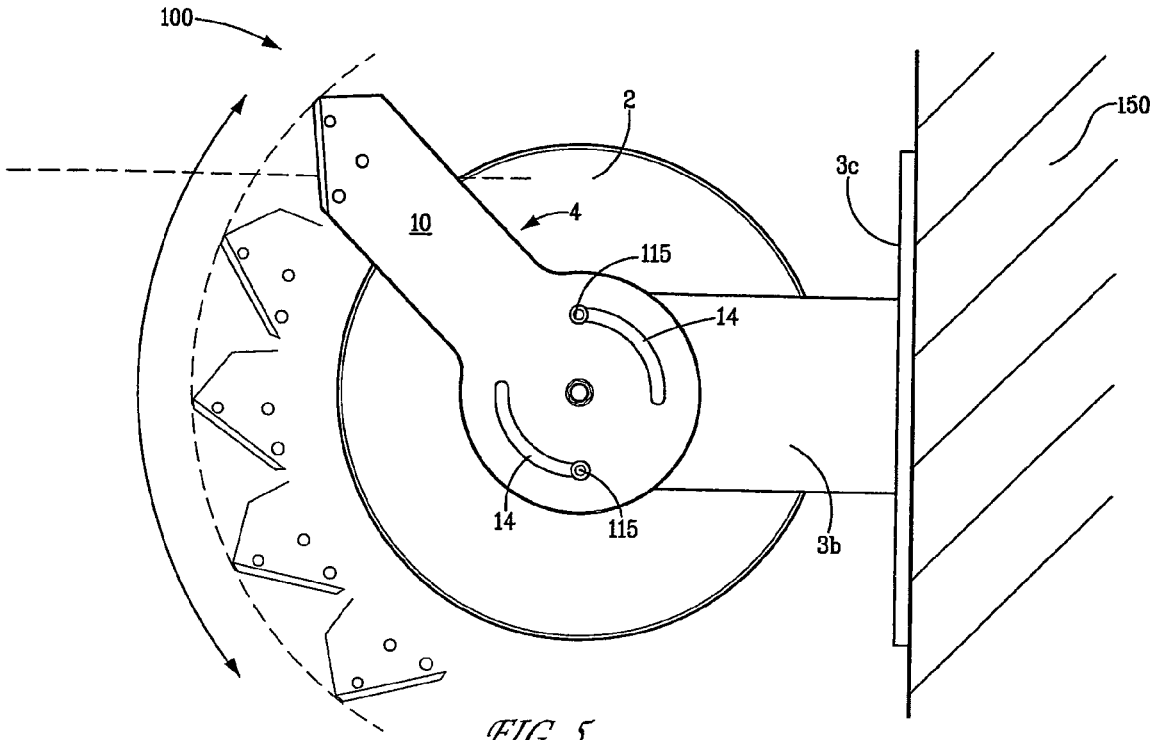

FIG. 5 shows a further embodiment of the invention. Although not shown for the sake of simplicity, the reel assembly 100 comprises a resilient biasing arrangement for the guide arrangement 4, which could be either as that shown in FIGS. 1 and 3, FIG. 4 or an alternative resilient biasing arrangement. When the assembly 100 is attached to an upright wall 150, in the undeflected or initial position, as shown in solid lines, the arm portions 10 are located at an angle of substantially forty five degrees to the horizontal. This is achieved by appropriately positioning the heads 115 on the upstanding portions 3*b*, which heads 115 are received in the arcuate slots 14. Also shown in FIG. 5 is the free end of the arm portion 10 at different angular positions. The maximum angular deflection of the arm portions 10 is substantially ninety degrees. Advantageously, the embodiment shown in FIG. 5 allows the roller guide 19 to face the user regardless of whether he is directly below the reel assembly or whether he is, say, ten metres away. This ensures that the same effort is required by the user to withdraw hose, no matter where he is positioned relative to the reel assembly 100.

Figure 6:
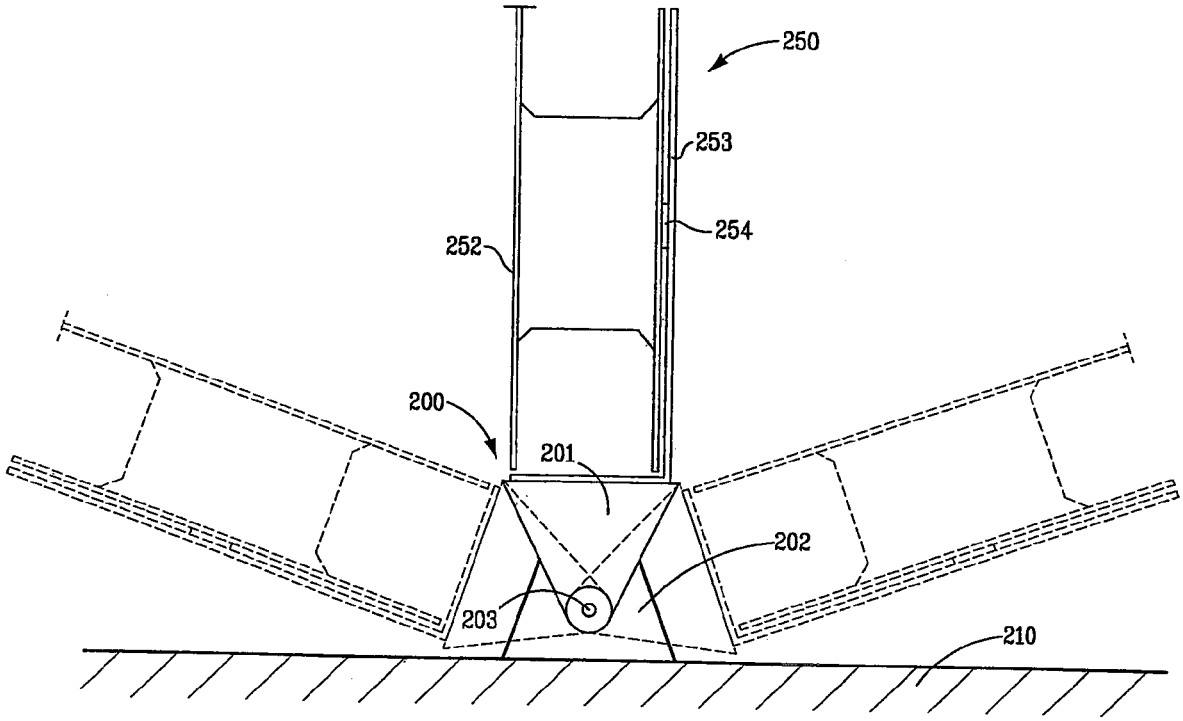
FIG. 6 is an aerial view of a reel assembly attached to a pivotable bracket assembly.

Any of the above described reel assemblies may be provided with a pivotable bracket assembly, such as the pivotable bracket 200 shown in FIG. 6. The bracket 200 comprises a first portion 201 which is 10 connected to a reel assembly 250, and a second portion 202 which is attached to a wall 210. The bracket portion 201 is pivotably connected to the bracket portion 202 by way of a pivot 203. The pivot 203 allows the portion 201 to pivot relative to the portion 202. The reel assembly 250 comprises a drum portion 252 and a mounting structure 253. The drum 15 portion 252 is rotatably connected to the mounting structure 253 by way of a pivot 254. Although the reel assembly 250 does not include a pivotable guide arrangement (like the earlier described embodiments), it is shown merely to illustrate the operation of the bracket assembly 200. It will be appreciated that any of the earlier described reel assemblies 20 could be used with the bracket assembly 200. In use, the bracket assembly 200 is capable of allowing for lateral movement of an end of a hose (which would cause pivoting movement of the reel assembly and the portion 201) relative to the mounting location of the bracket assembly 200 on the wall 210. The broken line representations show the 25 full extent of pivotable movement possible.

It will be appreciated that although the above described embodiments relate to reel assemblies for use with hose, other embodiments of the invention find application in relation to reel assemblies for other types of elongate material such as rope, cable and tape.

What is claimed:

1. A reel assembly comprising a pivotable guide arrangement for guiding material to and from a rotatable drum portion of the reel assembly, the pivotable guide arrangement being resiliently biased towards an undeflected position, the guide arrangement comprising a guide portion to contact with and guide the material and the guide arrangement pivotably mounted for the guide portion to follow an arcuate path which is coaxial with the rotatable drum portion, and the reel assembly further comprising a mounting structure, and the drum portion and the guide arrangement being mounted on the mounting structure, wherein the guide arrangement comprising arcuate slots, and the mounting structure comprising a respective head received in each slot, the slots arranged to bear against the respective heads so as to limit the extent of pivotable movement of the guide arrangement.

2. The reel assembly as claimed in claim 1 in which the mounting structure is arranged to be secured to an upright wall.

3. The reel assembly as claimed in claim 1 in which the guide arrangement comprises a limb portion which extends substantially radially of the axis of the rotatable drum portion and the guide portion which extends from the limb portion substantially parallel to the drum axis.

4. The reel assembly as claimed in claim 3 in which the guide portion comprises a roller arrangement.

5. The reel assembly as claimed in claim 1 which comprises a resilient biasing arrangement which comprises a spring member, one portion of which is secured to the mounting structure and another portion of which is secured to the guide arrangement.

6. The reel assembly as claimed in claim 5, in which the spring member comprises a coiled spring.

7. The reel assembly as claimed in claim 1 in which the pivotable guide arrangement is arranged to have a maximum angular deflection of substantially ninety degrees.

8. The reel assembly as claimed in claim 1 in which, in situ, the undeflected position is at approximately forty five degrees to the horizontal.

* * * * *